US006321510B2

(12) United States Patent
Preisner et al.

(10) Patent No.: US 6,321,510 B2
(45) Date of Patent: Nov. 27, 2001

(54) METHOD OF WRAPPING DRINKING STRAWS

(75) Inventors: Peter M. Preisner, Quinton; Hans-Joachim Oppe, Midlothian, both of VA (US)

(73) Assignee: Hauni Richmond, Inc., Richmond, VA (US)

( * ) Notice: Subject to any disclaimer, the term of this patent is extended or adjusted under 35 U.S.C. 154(b) by 0 days.

(21) Appl. No.: 09/766,478

(22) Filed: Jan. 19, 2001

Related U.S. Application Data

(62) Division of application No. 09/357,607, filed on Jul. 20, 1999, now Pat. No. 6,212,860.

(51) Int. Cl.[7] ..... B65B 61/18

(52) U.S. Cl. ..... 53/412; 53/411; 53/409; 53/450; 53/461; 53/462

(58) Field of Search ..... 53/136.2, 131.4, 53/131.5, 133.6, 133.7, 148, 545, 547, 548, 550, 411, 412, 416, 409, 450, 461, 462, 463; 239/33

(56) References Cited

U.S. PATENT DOCUMENTS

| | | | | |
|---|---|---|---|---|
| 1,980,913 | * | 11/1934 | Doll | 53/411 |
| 2,580,456 | * | 1/1952 | Noe | 53/545 |
| 2,584,060 | * | 1/1952 | Stephano | 53/547 |
| 3,473,286 | * | 10/1969 | Henry | 53/411 |
| 3,641,884 | * | 2/1972 | Jivoin | 239/33 |
| 3,667,971 | * | 6/1972 | Brunner | 53/547 |
| 4,183,192 | * | 1/1980 | Smaw | 53/151 |
| 4,721,119 | * | 1/1988 | Ludszeweit et al. | 493/49 |
| 5,427,316 | * | 6/1995 | Leone | 239/33 |
| 5,442,897 | * | 8/1995 | Hinzmann et al. | 53/450 |
| 5,636,498 | * | 6/1997 | Belanger et al. | 53/148 |
| 5,694,745 | * | 12/1997 | Spatafora et al. | 53/450 |
| 5,722,219 | * | 3/1998 | Dobransky | 53/461 |
| 5,957,279 | * | 9/1999 | Howes | 239/33 |
| 6,050,065 | * | 4/2000 | Bonde | 53/550 |
| 6,223,505 | * | 5/2001 | Meetze et al. | 53/450 |

* cited by examiner

*Primary Examiner*—Scott A. Smith
*Assistant Examiner*—Louis Huynh
(74) *Attorney, Agent, or Firm*—Peter K. Kontler

(57) ABSTRACT

Sipping straws are confined in discrete envelopes while advancing in a single file of spaced-apart straws through a wrapping station. The envelopes are obtained from a continuous strip of wrapping paper which is conveyed to the wrapping station in the direction of advancement of the file of spaced-apart straws and is draped around the straws in such a way that one of its longitudinally extending marginal portions overlies and adheres to the other marginal portion with simultaneous formation of a seam rather than an outwardly extending fin. The thus obtained tubular wrapper is thereupon severed in the gaps between successive spaced-apart straws, and the end portions of the thus obtained discrete envelopes are sealed by knurling, e.g., simultaneously with severing of the tubular wrapper.

10 Claims, 4 Drawing Sheets

METHOD OF WRAPPING DRINKING STRAWS

CROSS-REFERENCE TO RELATED CASE

This is a division of commonly owned patent application Ser. No. 09/357,607 filed Jul. 20, 1999, now U.S. Pat. No. 6,212,860 granted Oct. 4, 2001.

BACKGROUND OF THE INVENTION

The present invention relates to improvements in the making of wrapped drinking or sipping straws, and more particularly to improvements in the methods of and apparatus for confining drinking of sipping straws (hereinafter called sipping straws) in tubular envelopes of paper or the like.

It is well known to confine sipping straws in suitable elongated tubular envelopes of thin paper or the like. As a rule, conventional apparatus for the making and wrapping of sipping straws comprise an extruder that turns out a continuous tube which is normally made of a suitable plastic material (e.g., a transparent or translucent plastic material) and is caused to pass through a cutter. The latter repeatedly severs the leader of the tube to thus convert it into a file or row of discrete sections (hereinafter called straws) of desired length. The thus obtained straws are thereupon wrapped into envelopes in such a way that each envelope exhibits a longitudinally extending flap or fin and is closed at the ends. The making of fins and closing at the ends is accomplished by resorting to suitable knurling tools which interlace overlapping portions of the respective envelopes. Such knurling necessarily involves the making of rather pronounced fins which interfere with predictable confinement of wrapped sipping straws in cardboard boxes or other types of containers. Furthermore, the wrapping operation does not always result in the making of airtight seals and the flaps detract from the appearance of the ultimate products.

The maximum output of presently known apparatus for wrapping sipping straws is in the range of between about 600 and 1000 per minute. On the other hand, an extruder can turn out 2000 or even more straws per minute. Thus, the extruder must operate at less than full capacity due to the lesser output of the wrapping apparatus.

Another drawback of presently known and utilized apparatus for making and wrapping sipping straws is that their requirements for wrapping paper or other suitable wrapping material greatly exceed the minimal requirements which must be satisfied in order to adequately confine and preferably seal or substantially seal an individual straw in a tubular envelope. The disparity between the required quantities of wrapping material and the number of wrapped sipping straws which are turned out per unit of time increases with increasing lengths of the straws.

In addition, the rather limited capacity of conventional straw wrapping or draping apparatus renders it necessary to increase the number of extruding, wrapping and cartoning machines which, in turn, contributes significantly to the overall cost and necessitates the utilization of additional floor space as well as the services of additional attendants.

OBJECTS OF THE INVENTION

An object of the invention is to provide a novel and improved wrapping or draping apparatus for sipping straws.

Another object of the invention is to provide a novel and improved apparatus for on-line making, wrapping and packing sipping straws.

A further object of the invention is to provide a novel and improved method of wrapping sipping straws in an economical manner.

An additional object of the invention is to provide an apparatus which can wrap sipping straws at a rate that is a multiple of the capacities of presently known straw wrapping apparatus.

Still another object of the invention is to provide an apparatus which can wrap sipping straws in such a way that the space requirements of the ultimate products, e.g., in a box or carton, are less pronounced than those of presently known wrapped or draped sipping straws.

A further object of the invention is to provide wrapped sipping straws which can be more readily confined in cartons or other types of receptacles than presently known and presently available wrapped sipping straws.

Another object of the invention is to provide an apparatus which can mass produce wrapped sipping straws with substantial savings in paper or other wrapping material.

An additional object of the invention is to provide an apparatus which can ensure the wrapping of sipping straws in a highly satisfactory manner superior to that achievable by resorting to heretofore known wrapping apparatus.

Still another object of the invention is to provide an apparatus which can be readily converted for the wrapping of longer, shorter, smaller-diameter or larger-diameter, rigid or flexible sipping straws.

A further object of the invention is to provide an apparatus for wrapping sipping straws the space requirements of which are considerably less than those of presently known apparatus.

Another object of the invention is to provide an apparatus which can be automated to a desired extent and the output of which can be varied within a wide range, e.g., starting at a minimum output at least matching the maximum output of presently known apparatus.

An additional object of the invention is to provide the above outlined apparatus with a novel and improved straw wrapping unit.

Still another object of the invention is to provide a production line which employs a straw wrapping apparatus and means for delivering sipping straws from a source (such as an extruder) to the wrapping apparatus, and wherein the delivering means is designed to compensate for eventual fluctuations of the output of the source and/or for eventual fluctuations of the requirements of the wrapping and/or packing apparatus.

A further object of the invention is to provide a production line which employs at least one straw wrapping apparatus, at least one packing apparatus for freshly wrapped straws and means for transferring wrapped straws from at least one source to the at least one packing apparatus in such a way that the operation of the packing apparatus is not affected by eventual fluctuations of the operation of the wrapping apparatus and/or vice versa.

Another object of the invention is to provide sipping straws which are produced in the above outlined apparatus or production lines and/or in accordance with the above outlined method.

SUMMARY OF THE INVENTION

One feature of the present invention resides in the provision of a wrapped sipping straw which comprises an elongated open-ended tube and an envelope which confines the tube and includes a converted strip of flexible wrapping material. The envelope has two overlapping marginal portions which extend longitudinally of the tube and form a seam wherein one of the marginal portions is bonded to the other marginal portion.

The seam is preferably formed in such a way that the inner side of the other marginal portion is adjacent the tube and the inner side of the one marginal portion is bonded to the outer side of the other marginal portion.

It is often preferred to provide the converted strip with end portions which at least substantially close the envelope at the ends of the tube.

The tube can consist of a plastic material and the converted strip can consist of or at least contain paper.

The envelope can be further provided with at least one weakened portion which at least partially surrounds the tube intermediate the end portions of the envelope and serves to break (such as tear) in response to the exertion of a pull upon at least one of the end portions relative to the other end portion. The at least one weakened portion can include at least one group (e.g., a circumferentially extending row) of perforations.

At least one end portion of the converted strip can be closed (or even sealed) by knurling with a suitable tool, e.g., a rotary knife.

The envelope can have an at least substantially circular cross-sectional outline and is preferably devoid of external radial or substantially radial protuberances (such as the aforediscussed fins of conventional wrappers for sipping straws).

Another feature of the instant invention resides in the provision of a method of confining open-ended sipping straws in discrete envelopes. The improved method comprises the steps of gathering unconfined sipping straws into at least one accumulation (e.g., in a hopper) of at least substantially parallel straws, transporting from the accumulation at least one file of spaced-apart successive straws lengthwise toward and through a wrapping station, advancing toward and through the wrapping station a strip of wrapping material having two at least substantially parallel marginal portions, applying an adhesive to at least one marginal portion of the strip not later than at the wrapping station, draping the strip around successive spaced-apart straws of the at least one file at the wrapping station so that the one marginal portion overlies and adheres to the other marginal portion to thus form a seam extending longitudinally of the thus confined straws, and severing the draped strip between successive confined straws.

The method can further comprise the step of at least partially sealing (e.g., actually merely closing) the draped strip at least at one end of each confined straw. Such sealing step can include knurling the draped strip at one or both ends of each confined straw. The sealing step can be carried out simultaneously with the severing step (e.g., by resorting to a suitable composite or combined severing and sealing or closing tool).

The method can further comprise the step of applying to longitudinally spaced-apart portions of the strip items of information (such as printed matter) prior to the draping step and in such distribution that each envelope exhibits some of the printed matter (the printed matter can repeat itself so that each envelope carries identical bits or items of information).

The severing step can include providing each envelope with the aforementioned end portions extending beyond the open ends of the respective confined straws, and such method can further comprise the step of weakening the strip at a plurality of longitudinally spaced-apart locations so that each discrete envelope is provided with at least one weakened portion where the envelope breaks (such as tears) in response to the application of a pull to at least one end portion relative to the other end portion of the envelope. This simplifies the removal or extraction of the straw from its envelope.

The adhesive applying step can include applying to the at least one marginal portion of the strip a film of hot melt or another suitable adhesive substance. If the adhesive is a hot melt, it is often advisable to cool the seam downstream of or already at the wrapping station The method can further comprise the steps of forming a continuous tube (e.g., as a result of extrusion of a suitable plastic material through the annular orifice of a suitable die), and dividing the tube into a plurality of open-ended sipping straws at a location which can be spaced apart from the aforementioned accumulation. The gathering step then preferably comprises conveying a mass flow of unconfined straws from the aforementioned location to the accumulation.

A further feature of the invention resides in the provision of an apparatus for confining elongated open-ended sipping straws in discrete envelopes. The improved apparatus comprises a facility for temporary storage of an accumulation of unconfined (unwrapped) straws, means for transporting at least one file of spaced-apart successive straws from the facility lengthwise along a predetermined path, means for advancing to a predetermined portion of the path a strip or web of wrapping material having two preferably parallel marginal portions, means for applying an adhesive to at least one marginal portion of the strip not later than in the predetermined portion of the path, means for draping the strip around succesive spaced-apart straws in the predetermined portion of the path so that the at least one marginal portion overlies and adheres to the other marginal portion, and means for severing the draped strip between successive confined straws.

The apparatus can further comprise means (such as an extruder) for forming a continuous tube, means for dividing the continuous tube into a plurality of open-ended straws, means for gathering the thus obtained straws into a pile (e.g., into a mass flow) and means for conveying the mass flow of straws from the pile to the facility.

The apparatus can further comprise means for at least partially closing or sealing the draped strip at the ends of the confined straws. Such sealing or closing means can comprise means for knurling the draped strip at one or both ends of each confined straw. The just discussed sealing or closing means can form part of the severing means or vice versa.

The apparatus can further comprise means for applying to longitudinally spaced-apart portions of the strip items of information prior to draping of the strip so that each envelope exhibits at least one item of information (e.g., printed matter denoting the name of the manufacturer, the trademark of the owner, the dimensions and/or the color of the straw, and/or other data).

The draping means can comprise means for causing one side of the other marginal portion of the strip to overlie the straws in their path and for causing one side of the one marginal portion to overlie and to adhere to the other side of the other marginal portion.

The severing means can include means for providing each envelope with end portions extending beyond the open ends of the respective confined straws, and such apparatus can further comprise means for weakening the strip at a plurality of spaced-apart locations so that each discrete envelope can exhibit at least one weakened portion where the envelope breaks or is expected to break in response to a pull upon at least one end portion relative to the other end portion of the envelope.

The novel features which are considered as characteristic of the invention are set forth in particular in the appended claims. The improved method, apparatus and product themselves, however, both as to their construction and their modes of operation, together with numerous additional important features and attributes thereof, will be best understood upon perusal of the following detailed description of certain presently preferred specific embodiments with reference to the accompanying drawings.

DESCRIPTION OF PREFERRED EMBODIMENTS

Figure 1:
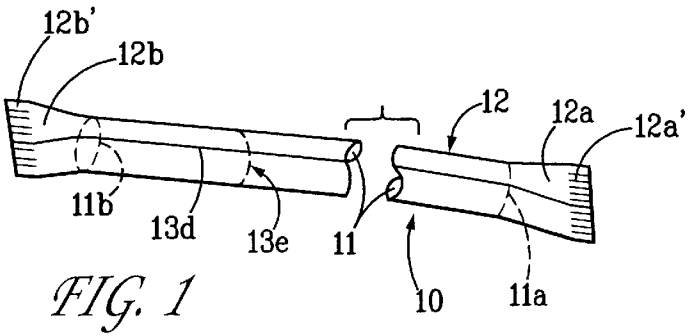
FIG. 1 is a fragmentary perspective view of a finished envelope.

FIG. 1 shows a portion of a wrapped sipping (drinking) straw 10 which comprises an elongated straw 11 having open ends 11*a*, 11*b* and normally constituting an extrudate. The tube 11 is confined in an elongated envelope 12 constituting a converted elongated portion 13*a* (FIG. 2) of a continuous (endless) strip or web 13 (FIG. 5) of cigarette paper or another suitable flexible wrapping material for sipping straws.

Figure 2:
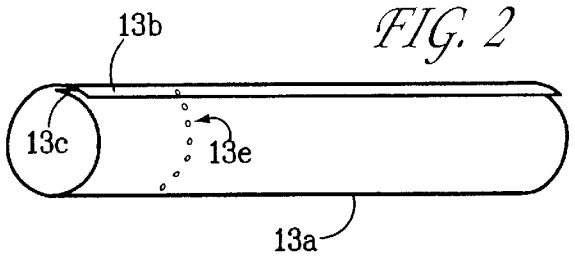
FIG. 2 is an enlarged fragmentary perspective view of a portion of a convoluted strip of wrapping material prior to bonding of the two marginal portions of the strip to each other.
Figure 7:
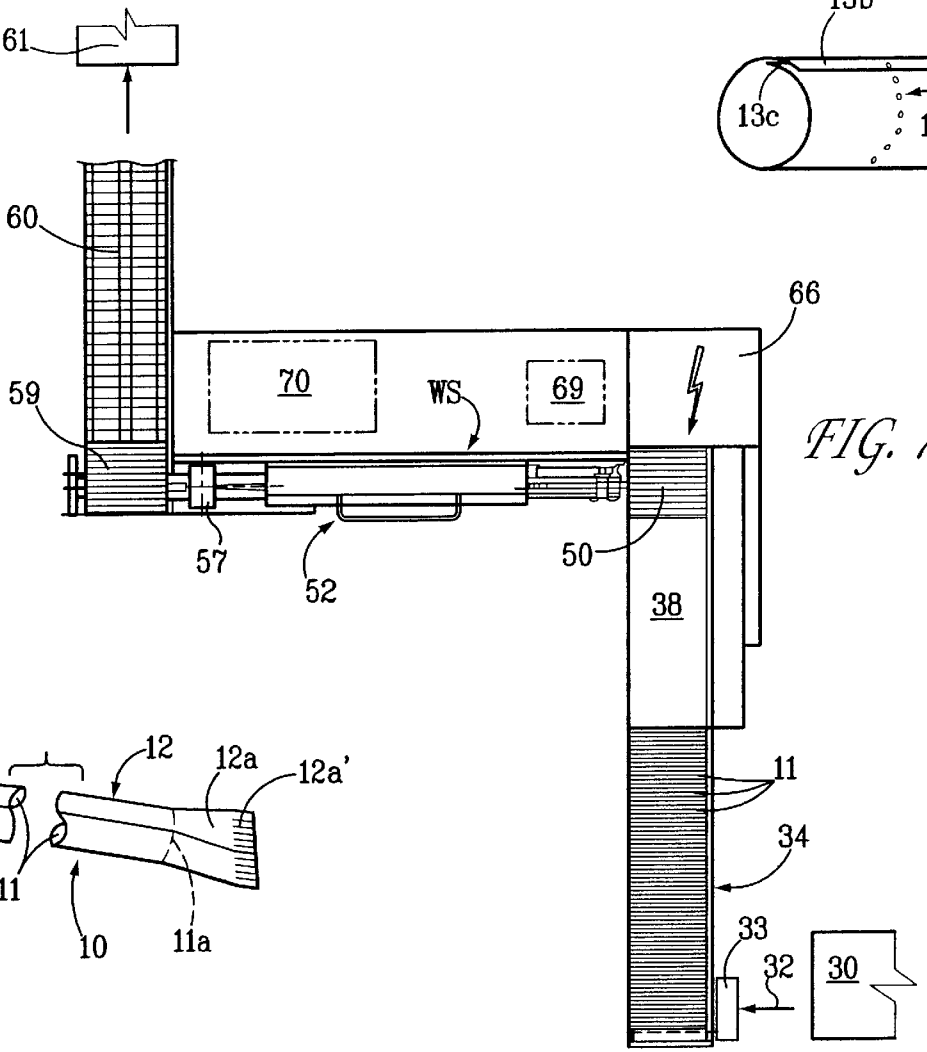
FIG. 7 is a plan view of the apparatus which is shown in FIGS. 5 and 6.
Figure 3:
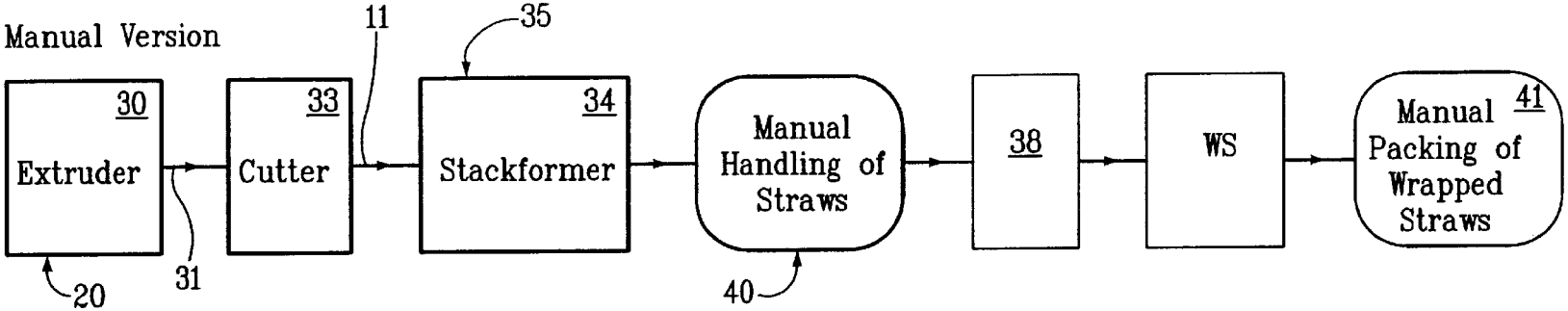
FIG. 3 is a flow diagram showing a series of steps forming part of one embodiment of the improved method.
Figure 4:
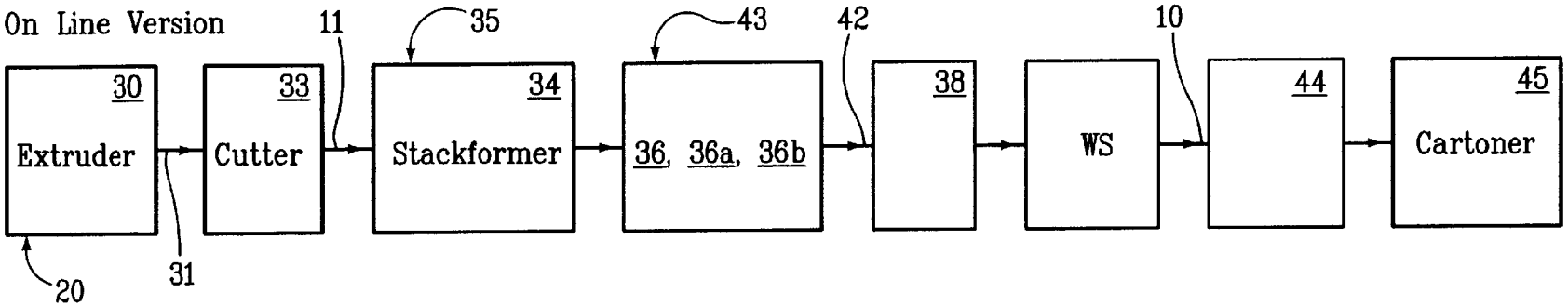
FIG. 4 is a flow diagram showing a series of steps forming part of another embodiment of the improved method.
Figure 5:
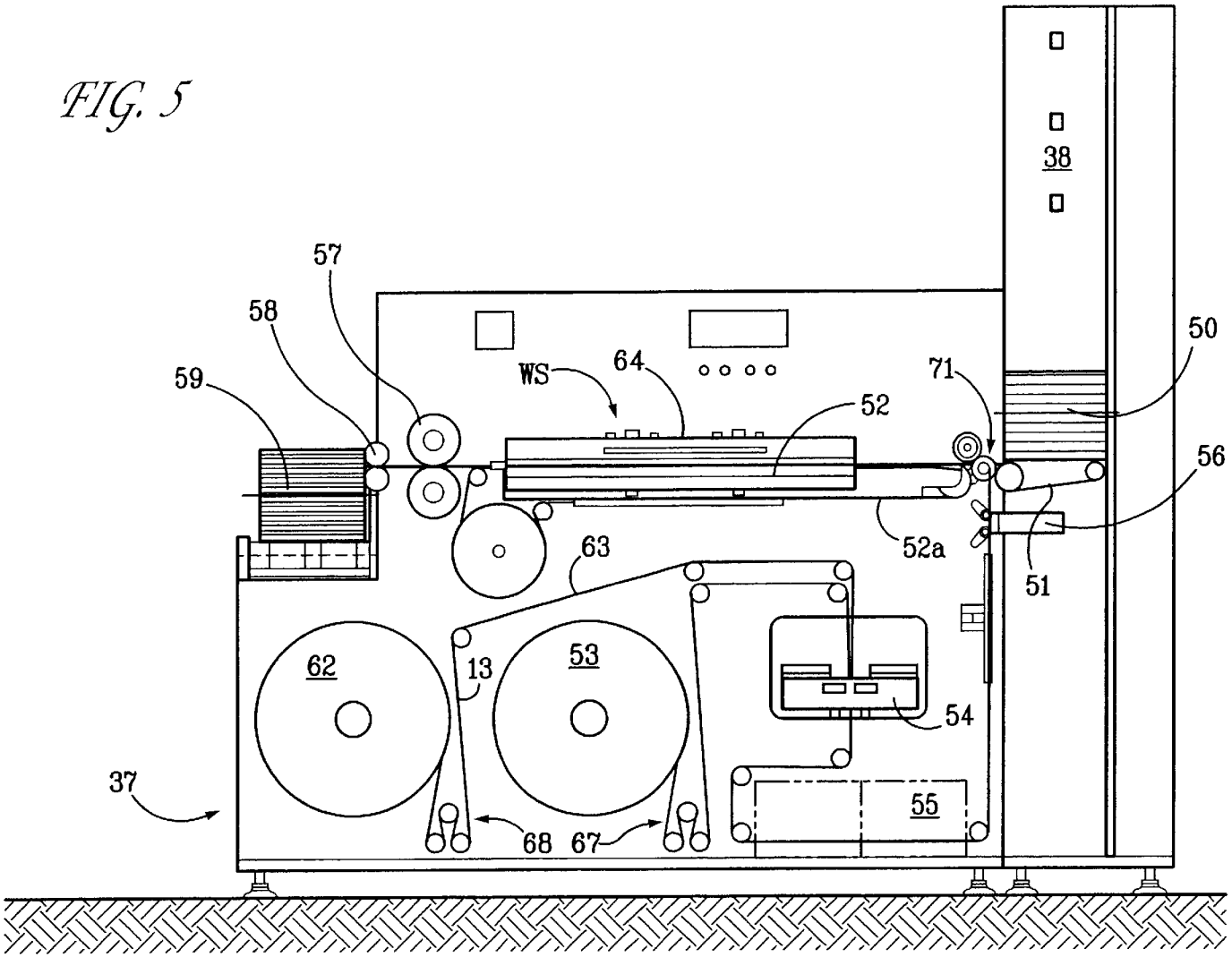
FIG. 5 is a front elevational view of an apparatus which embodies one presently preferred form of the invention.

As shown in FIG. 2, the portion 13*a* of strip 13 has two elongated parallel marginal portions 13*b*, 13*c* which overlap each other and form an elongated seam 13*d* (FIG. 1) when the conversion of the portion 13*a* into an envelope 12 is completed downstream of a wrapping station WS shown in each of FIGS. 3 to 7 (see particularly FIGS. 5 and 7). The envelope 12 further comprises two end portions 12*a*, 12*b* which are respectively adjacent the open ends 11*a*, 11*b* of the confined straw 11 and have knurled terminal parts 12*a*', 12*b*' serving to at least partially seal (e.g., merely close) the respective end portions 12*a*, 12*b*.

It is often preferred to provide the elongated median portion of the envelope 12 with at least one weakened portion 13*e* which enables the user to gain access to the confined straw 11 with a minimum of effort or with a lesser effort. The weakened portion 13*e* which is shown in FIG. 1 has an annular or an arcuate row of perforations extending circumferentially of the envelope. The weakened portion 13*e* can be caused to break by tearing the wrapping material between neighboring perforations in response to the exertion of a pull upon the two end portions 12*a*, 12*b* or in response to the exertion of a pull upon one (e.g., 12*a*) of the end portions 12*a*, 12*b* while the part of the envelope 12 at the other side of the row of perforations is held against movement or is pulled away from the one end portion 12*a*.

The outer side of the marginal portion 13*c* and/or the inner side of the marginal portion 13*b* is coated with a film of a suitable adhesive (e.g., a hot melt) which bonds the two marginal portions to each other to thus form the aforementioned seam 13*d*. It is clear that the seam can be formed by bonding the inner side of the marginal portion 13*c* to the outer side of the marginal portion 13*b*. Regardless of the exact nature of the seam 13*d* (i.e., whether the marginal portion 13*b* is located at the outer side of the marginal portion 13*c*, or vice versa), a feature of the invention resides in that the marginal portions 13*b*, 13*c* are caused to form a seam 13*d* in lieu of a conventional protuberance (such as a flap or fin) which is located at the outer side of and is pivotable relative to the elongated cylindrical main portion or section of a standard envelope. Reference may be had to wrapped straws distributed by Sweetheart, Chicago, Ill. under the mark "Sweetheart". The fins or flaps of the envelopes of such conventional wrapped straws are obtained by knurling and, therefore, the quantity of wrapping material for the making of envelopes exhibiting fins considerably exceeds the quantity of wrapping material which is needed for the making of envelopes 12 of he type shown in applicants' FIG. 1.

Figure 6:
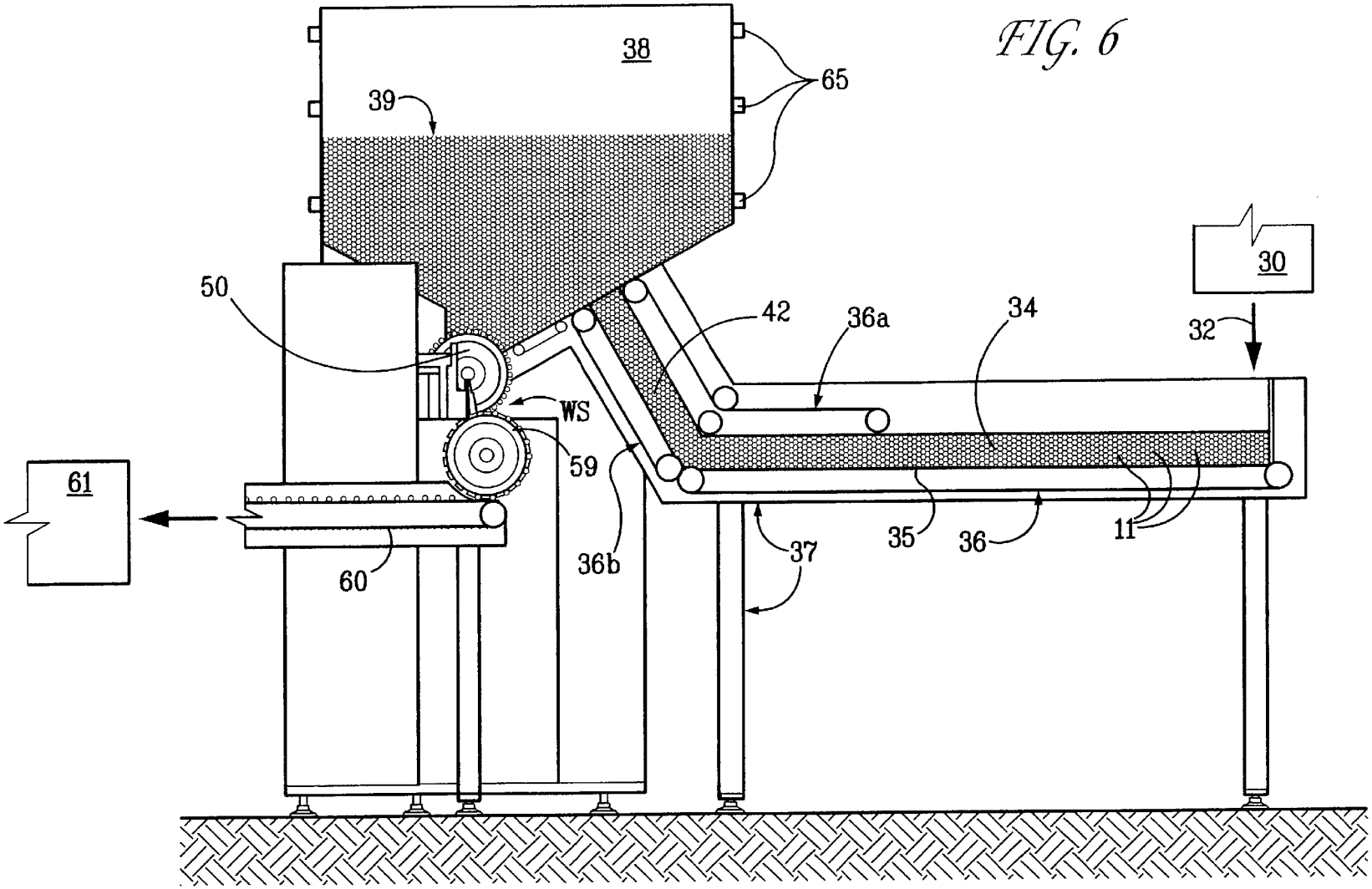
FIG. 6 is a side elevational view of the apparatus as seen from the right-hand side of FIG. 5.

The steps of one presently preferred embodiment of our method of making wrapped sipping straws (10) of the type shown in FIG. 1 are shown schematically in FIG. 3. The first step 20 involves the making of a continuous tube 31 which is normally furnished by an extruder 30 (FIGS. 6 and 7) and is advanced lengthwise (arrow 32 in FIGS. 6 and 7) toward and through a cutter 33 serving as a means for dividing the tube 31 into a single file of discrete elongated open-ended sipping straws 11 which are gathered into a pile 34 on a stack former 35. In FIG. 6, the stack former 35 includes the upper reach of an endless belt or chain conveyor 36 installed in a frame 37.

The next step of this relatively simple method involves a manual transfer (at 40) of sets or groups of parallel straws 11 from the pile 34 into a hopper 38 to gather an accumulation 39 of parallel straws upstream of the wrapping station WS. A presently preferred mode of wrapping successive spaced-apart straws 11 of a file of such straws in the running strip 13 will be described with reference to FIG. 5.

The last step 41 of the method including the steps represented by the blocks of the diagram shown in FIG. 3 includes manually packing preselected numbers (e.g., twenty, fifty, hundred or more) of wrapped straws 10 into suitable containers (not shown), such as cardboard or plastic boxes, bags or the like.

The method including the steps already described with reference to the diagram of FIG. 3 normally further comprises one or more additional steps (such as the application of items of information to the strip 13, providing the strip 13 or the elongated portions 13*a* of the strip 13 with weakened portions (such as perforations) 13*e*, cooling the seam 13*d* to promote setting of the adhesive, and/or others); such step or steps are carried out by instrumentalities which are or can be identical with or analogous to those which will be described in connection with FIGS. 4 to 7 and/or which are described and shown in the referenced patents.

The first three steps of the method represented by the block diagram of FIG. 4 are or can be identical with the first three steps of the afore described method represented by the block diagram of FIG. 3 and are identified by similar reference characters. The manual handling step 40 of FIG. 3 is replaced by an automatic step 43 carried out by a series of conveyors including the aforementioned endless belt or chain conveyor 36 and additional endless conveyors 36*a*, 36*b*. The conveyors 36, 36*a* and 36*b* (see particularly FIG. 6) carry out the gathering step which involves automatically conveying or transporting a mass flow 42 of several layers or strata of straws 11 from the pile 34 into the hopper 38 to form the accumulation 39.

The outlet of the hopper 38 discharges straws 11 into the wrapping station WS, and the wrapped straws 10 issuing from the station WS enter the range of an interface 44 (including the conveyors 59, 60 shown in FIGS. 6 and 7) which couples the outlet of the wrapping station WS with a packing station 45 including a suitable cartoner 61 (shown schematically in FIGS. 6 and 7).

The operation of the endless belt or chain conveyors 36, 36*a*, 36*b* can be, and preferably is, automated in order to ensure that the hopper 38 invariably contains an adequate accumulation of parallel straws 11, namely an accumulation which suffices to guarantee continuous operation of various devices at the wrapping station WS even if the speed of the extruder 30 must be reduced for a certain interval of time or even if the extruder is brought to a full stop for a maximum anticipated period of time (e.g., for the purposes of cleaning, other maintenance, repair, replacement of parts, failure of the means for supplying a plasticized material to the extruder and/or other problems).

Analogously, the hopper 38 should be capable of taking up the output of the extruder 30 if and when one or more devices or units at the wrapping station WS are caused to operate at less than normal speed or are brought to a complete stillstand.

The units at the wrapping station WS include a fluted rotary collating drum 50 which is located below an outlet in the bottom portion of the hopper 38 and serves to transport sideways successive straws 11 of a series of parallel straws into the range of a belt conveyor 51 serving to propel a file of successive straws of the series in the flutes of the collating drum 50 into an elongated straight (normally at least substantially horizontal) path defined by a so-called garniture 52 wherein successive spaced-apart straws 11 are confined in the strip 13.

The strip 13 is supplied by an expiring bobbin or reel 53 which is rotatably and removably mounted in the frame 37. From the bobbin 53, the strip 13 advances through a splicer 54, thereupon through a printer 55 which provides longitudinally spaced-apart portions of the strip with information, thereafter along a paster 56, and finally into the garniture 52. The printer 55 can apply items of information (such as printed matter including the trademark and the name and address of the manufacturer and/or the distributor, the dimensions of the straws and/or others) in such distribution that the envelope 12 of each finished product (wrapped straw) 10 bears all of the information.

The paster 56 (for example, a so-called hot melt glue gun) supplies adhesive which forms a film on the marginal portion 13*b* and/or 13*c* of the running strip 13.

Garnitures of the type adapted to be utilized at 52 can be identical with those used in cigarette and filter rod making machines, e.g., in machines described and shown in U.S. Pat. No. 5,060,665 (granted Oct. 29, 1991 to Heitmann for "WRAPPING MECHANISM FOR ROD MAKING MACHINES OF THE TOBACCO PROCESSING INDUSTRY"), U.S. Pat. No. 4,185,644 (granted Jan. 29, 1980 to Heitmann et al. for "DISTRIBUTOR FOR CIGARETTE MAKERS OR THE LIKE"), U.S. Pat. No. 4,721,119 (granted Jan. 26, 1988 to Ludszeweit et al. for "ROD MAKING MACHINE WITH MEANS FOR ADJUSTING THE POSITION OF WRAPPING MATERIAL") and U.S. Pat. No. 3,974,007 (granted Aug. 10, 1976 for "METHOD AND APPARATUS FOR THE PRODUCTION OF FILTER ROD SECTIONS OR THE LIKE").

Apparatus for making perforations in running webs or strips of wrapping material (such as cigarette paper or so-called tipping paper for use in machines for the making of filter cigarettes) are disclosed, for example, in U.S. Pat. No. 4,281,670 (granted Aug. 4, 1981 to Heitmann et al. for "APPARATUS FOR INCREASING THE PERMEABILITY OF WRAPPING MATERIAL FOR ROD-SHAPED SMOKERS' PRODUCTS") and U.S. Pat. No. 4,469,111 (granted Sep. 4, 1984 to Pinck et al. for "APPARATUS FOR PERFORATING WEBS OF WRAPPING MATERIAL FOR TOBACCO OR THE LIKE"). Such apparatus can be utilized to provide the strip 13 with weakened portions 13*e* shown in FIGS. 1 and 2.

The disclosures of the above-enumerated patents are incorporated herein by reference.

The only important difference between the patented garnitures and the garniture 52 in the apparatus shown in FIGS. 5 and 7 of the present application is that the conveyor 51 shown in FIG. 5 is operated to propel successive straws 10 from successive peripheral flutes of the drum 50 at intervals which are required to establish between successive straws 11 in the garniture 52 gaps of a width which suffices to sever (at 57) the strip 13 at selected distances from the open ends 11*a*, 11*b* of the two neighboring straws 11. This enables the knurling tool (e.g., a toothed wheel having two portions flanking a circular knife of the severing means 57) to provide the end portions 12*a*, 12*b* of the envelopes 12 with the knurled ends 12*a*', 12*b*' at requisite distances from the open ends 11*a*, 11*b* of the respective confined straws 11.

The severing means 57 is followed by two accelerating rollers 58 which propel successively formed discrete wrapped sipping straws 10 into the axially parallel peripheral flutes of the indexible drum-shaped conveyor 59 forming part of the aforementioned interface 44. The conveyor 59 serves to transfer successive wrapped straws 10 onto the upper reach of the endless belt-shaped conveyor 60 of the interface 44. The conveyor 60 delivers a flow of wrapped straws 10 to the packing station 45 where the cartoner 61 introduces arrays of predetermined numbers of wrapped straws 10 into discrete receptacles in the form of cartons, boxes, bags or the like. For example, the cartoner 61 can be designed to introduce arrays of wrapped straws 10 into boxes in a so-called quincunx formation which is customary in the packets of plain or filter cigarettes.

As already mentioned hereinbefore, the exact construction of the parts at the packaging station 45 forms no part of the present invention.

FIG. 5 further shows a spare bobbin or reel 62 for a second strip 63 having a leader at the splicer 54. The reference character 64 denotes a so-called cooler bar which is adjacent the path of the freshly formed seam 13*d* at the garniture 52 to promote the setting of the adhesive film previously applied by the hot melt glue gun 54. This renders it possible to place the severing means 57 into close or immediate proximity to the garniture 52.

FIG. 6 shows several level sensors 65 which are adjacent the accumulation of unconfined straws 11 in the hopper 38 and transmit signals to the signal processing arrangement (not specifically shown) in an electronic control unit 66

(FIG. 7) which automatically regulates the operation of various belt conveyors, drums and other mobile parts in order to ensure the establishment and maintenance of adequate supply of unwrapped straws 11 in the hopper 38, proper synchronization of the drive means 67, 68 for the shafts mounting the reels 53, 62 when the supply of strip 13 is nearly exhausted, synchronization of the speed of the printer 55 with the speed of the running strip 13, 63, etc.

FIG. 7 further shows a hot melt glue container 69 and a so-called chiller 70.

The relationship between the speeds of the propelling conveyor 51 and the so-called garniture tape 52*a* of the garniture 52 can be selected in such a way that the width of the gaps between successive spaced-apart unwrapped straws 11 entering the wrapping station WS is or approximates 30 mm. This normally suffices to ensure that the end portions 12*a*, 12*b* of each envelope 12 will have an optimum or an acceptable length, e.g., for proper engagement by the fingers of a user preparatory to breaking of the weakened portion 13*e*.

It has been found that the utilization of a garniture (52) in lieu of a conventional (knurling) device for providing the conventional envelopes or wrappers with finned longitudinally extending seals results in savings of wrapping material in the range of up to and in excess of 10–20 percent.

Furthermore, apparatus of the type shown in FIGS. 3 to 7 can turn out wrapped sipping straws 10 at a rate of up to 2000 per minute. On the other hand, the output of conventional apparatus is in the range of 600–1000 per minute. The improved apparatus can be automated to a desired extent (e.g., as explained with reference to FIG. 4 in comparison with the operation described with reference to FIG. 3), and necessitates a minimum of maintenance and supervision; this results in savings of not less than two employees per line and shift. Moreover, the floor space requirements of the improved apparatus are substantially below those of conventional apparatus, and the filling of boxes, cartons, bags and/or other receptacles for preselected numbers of wrapped sipping straws 10 is simplified because the envelopes 12 are devoid of fins. This renders it possible to confine larger numbers of novel wrapped straws 10 in containers which can accept fewer conventional wrapped straws with external fins. Still further, the possibility of confining larger numbers of wrapped straws 10 in containers capable of accepting fewer conventional wrapped straws with fins renders it possible to achieve savings in connection with the transport of boxes or like containers to storage and to purchasers.

Still further, the quality of envelopes 12 is superior to that of conventional envelopes with fins because the confined straws 11 are less likely to be damaged and/or defaced during introduction into containers as well as during withdrawal from containers and during removal from the envelopes.

Several components of the afore described apparatus which is shown in FIGS. 5 to 7 constitute optional features. For example, the mass flow conveyor system 36, 36*a*, 36*b*, the automatic splicer 54, the printer 55, the means (shown in FIG. 5, as at 71) for providing the strip 13 with weakened portions 13*e*, the conveyors 59, 60 of the interface 44, and the cartoner 61 constitute desirable and advantageous but optional features.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the method of and apparatus for confining sipping straws in envelopes of paper or the like and, therefore, such adaptations should and are intended to be comprehended within the meaning and range of equivalence of the appended claims.

We claim:

1. A method of confining open-ended sipping straws in discrete envelopes, comprising the steps of:

gathering unconfined straws into at least one accumulation of at least substantially parallel straws;

transporting from the accumulation at least one file of spaced-apart successive straws lengthwise toward and through a wrapping station;

advancing toward and through the wrapping station a strip of wrapping material having two marginal portions;

applying an adhesive to at least one marginal portion of the strip not later than at the wrapping station;

draping the strip around successive spaced-apart straws of the at least one file at the wrapping station so that the one marginal portion overlies and adheres to the other marginal portion to thus form a seam extending longitudinally of the thus confined straws; and severing the draped strip between successive confined straws.

2. The method of claim 1, further comprising the step of at least partially sealing the draped strip at least at one end of each confined straw.

3. The method of claim 2, wherein said sealing step comprises knurling the draped strip.

4. The method of claim 2, wherein said sealing step is carried out simultaneously with said severing step.

5. The method of claim 1, further comprising the step of applying to the strip printed matter prior to said draping step so that each envelope exhibits some of the applied printed matter.

6. The method of claim 1, wherein said severing step includes providing each envelope with end portions extending beyond the open ends of the respective confined straws, and further comprising the step of weakening the strip at a plurality of longitudinally spaced-apart locations so that each discrete envelope exhibits at least one weakened portion where the envelope breaks in response to the application of a pull to at least one end portion relative to the other end portion of the envelope.

7. The method of claim 1, wherein the adhesive applying step includes applying to the at least one marginal portion of the strip a film of hot melt.

8. The method of claim 7, further comprising the step of cooling the seam.

9. The method of claim 1, further comprising the steps of forming a continuous tube, and dividing the tube into a plurality of open-ended sipping straws at a location spaced apart from said accumulation, said gathering step comprising conveying a mass flow of unconfined straws from said location to said accumulation.

10. The method of claim 9, wherein said forming step includes extrusion of a plastic material.

* * * * *